US008534426B2

(12) United States Patent
Smith et al.

(10) Patent No.: US 8,534,426 B2
(45) Date of Patent: Sep. 17, 2013

(54) CONTROL FOR LIMITING ELEVATOR PASSENGER TYMPANIC PRESSURE AND METHOD FOR THE SAME

(75) Inventors: Rory Smith, El Cajon, CA (US); Richard Peters, Bucks (GB)

(73) Assignee: ThyssenKrupp Elevator Corporation, Atlanta, GA (US)

( * ) Notice: Subject to any disclaimer, the term of this patent is extended or adjusted under 35 U.S.C. 154(b) by 674 days.

(21) Appl. No.: 12/186,798

(22) Filed: Aug. 6, 2008

(65) Prior Publication Data

US 2009/0152053 A1 Jun. 18, 2009

Related U.S. Application Data

(60) Provisional application No. 60/954,205, filed on Aug. 6, 2007.

(51) Int. Cl.
*B66B 1/28* (2006.01)

(52) U.S. Cl.
USPC ..... 187/293; 187/391

(58) Field of Classification Search
USPC ..... 187/247, 277, 316, 391–393, 293, 187/296, 297, 380–382, 401, 414
See application file for complete search history.

(56) References Cited

U.S. PATENT DOCUMENTS

| | | | |
|---|---|---|---|
| 4,009,766 | A | 3/1977 | Satoh |
| 4,363,381 | A | 12/1982 | Bittar |
| 4,536,842 | A | 8/1985 | Yoneda et al. |
| 4,838,385 | A | 6/1989 | Ekholm |
| 4,926,976 | A | 5/1990 | Schroder |
| 4,930,603 | A | 6/1990 | Brenner |
| 4,991,694 | A | 2/1991 | Friedli |
| 4,993,518 | A | 2/1991 | van Straaten et al. |
| 5,024,295 | A | 6/1991 | Thangavelu |
| 5,056,628 | A | 10/1991 | Aime |
| 5,168,133 | A | 12/1992 | Bahjat et al. |
| 5,239,141 | A | 8/1993 | Tobita et al. |

(Continued)

FOREIGN PATENT DOCUMENTS

| | | |
|---|---|---|
| EP | 0321657 | 6/1989 |
| EP | 0324068 | 7/1989 |

(Continued)

OTHER PUBLICATIONS

English translation JP 08034571A.*

(Continued)

*Primary Examiner* — Anthony Salata
(74) *Attorney, Agent, or Firm* — Frost Brown Todd LLC

(57) ABSTRACT

An elevator control system to govern elevator movement to avoid or minimize passenger discomfort caused by pressure changes associated with an elevator's movement and to optimize elevator operation. In one exemplary embodiment, the system uses the passenger's natural relief which occurs while the elevator car is stopped to reduce the pressure difference experienced by the passengers' ears as a factor to optimally control the operation of the elevator. In another example, the system obtains input regarding the traveling speed and conditions of the elevator system. This system then simulates individual trips for passengers that includes monitoring the pressure changes being experienced by passengers throughout the elevator's travels in order to ensure that the pressure differential level for each passenger remains below a designated maximum comfortable and safe level. This system uses the parameters of a successful simulation to govern the actual operation of the elevators.

36 Claims, 8 Drawing Sheets

(56) References Cited

U.S. PATENT DOCUMENTS

| | | | | |
|---|---|---|---|---|
| 5,252,790 | A | 10/1993 | Aime | |
| 5,276,295 | A | 1/1994 | Kameli | |
| 5,305,194 | A | 4/1994 | MacDonald | |
| 5,305,198 | A | 4/1994 | Schroder et al. | |
| 5,389,748 | A | 2/1995 | Burke et al. | |
| 5,427,206 | A | 6/1995 | Powell et al. | |
| 5,511,635 | A | 4/1996 | Kameli | |
| 5,563,386 | A | 10/1996 | Powell et al. | |
| 5,689,094 | A | 11/1997 | Friedli et al. | |
| 5,780,789 | A | 7/1998 | Tsuji | |
| 6,000,504 | A | 12/1999 | Koh et al. | |
| 6,237,721 | B1 | 5/2001 | Siikonen | |
| 6,439,349 | B1 | 8/2002 | Smith | |
| 7,267,203 | B2 * | 9/2007 | Sekimoto | 187/393 |
| 7,762,875 | B2 * | 7/2010 | Sekimoto | 454/68 |
| 2002/0112922 | A1 | 8/2002 | Smith | |
| 2004/0222048 | A1 * | 11/2004 | Mizuno et al. | 187/401 |
| 2010/0267322 | A1 * | 10/2010 | Yamamoto et al. | 454/68 |

FOREIGN PATENT DOCUMENTS

| | | | | |
|---|---|---|---|---|
| EP | 0365782 | | | 5/1990 |
| EP | 0407731 | | | 1/1991 |
| EP | 0443188 | | | 8/1991 |
| EP | 0508094 | | | 10/1992 |
| EP | 0565864 | | | 10/1993 |
| EP | 0631965 | | | 1/1995 |
| EP | 0663366 | | | 7/1995 |
| EP | 0699617 | | | 3/1996 |
| EP | 0709332 | | | 5/1996 |
| JP | 1192686 | | | 8/1989 |
| JP | 4028681 | | | 1/1992 |
| JP | 6156893 | | | 6/1994 |
| JP | 6293478 | | | 10/1994 |
| JP | 07179277 | A | * | 7/1995 |
| JP | 08034571 | A | * | 2/1996 |
| JP | 08081162 | | | 3/1996 |
| JP | 9255245 | | | 9/1997 |
| JP | 10330050 | A | * | 12/1998 |
| JP | 2008 133126 | | | 6/2008 |
| JP | 2008260606 | A | * | 10/2008 |
| JP | 2009113933 | A | * | 5/2009 |
| JP | 2010030747 | A | * | 2/2010 |
| JP | 2010269855 | A | * | 12/2010 |
| JP | 2011057414 | A | * | 3/2011 |

OTHER PUBLICATIONS

English Translation JP 2008133126A.*

Translation JP2008-133126.*

Funai, K. et al. "Analysis of Tympanic Membrane Behavior and Ear Pressure Discomfort for Super High Speed Elevators," Mitsubishi Elevator Europe, The Netherlands et al., pp. 51-60.

International Search Report dated Nov. 6, 2008 for Application No. PCT/US2008/072305.

Munakata, T. et al., "The World's Fastest (1010 m/min) Elevator," Toshiba Elevator and Building Systems Corp., pp. 217-225.

Shudo, T. et al., "Effective Atmosphere Pressure Control for Ultra-High Speed Elevator," Proceedings of ELEVCON 2004, pp. 225-233.

Written Opinion dated Nov. 6, 2008 for Application No. PCT/US2008/072305.

Abstract for Application No. JP 1192686.

Abstract for Application No. JP 4028681.

Abstract for Application No. JP 6156893.

Abstract for Application No. JP 6293478.

Abstract for Application No. JP 9255245.

Abstract for Application No. JP 2008133126.

International Preliminary Report on Patentability dated Feb. 9, 2010 for Application No. PCT/US2008/072305.

* cited by examiner

| Floor | Height (m) | $PC_1$ (Pa) |
|---|---|---|
| 1 | 0 | 0.00 |
| 2 | 4 | -50.67 |
| 3 | 8 | -101.31 |
| 4 | 12 | -151.92 |
| 5 | 16 | -202.51 |
| 6 | 20 | -253.08 |
| 7 | 24 | -303.62 |
| 8 | 28 | -354.14 |
| 9 | 32 | -404.62 |
| 10 | 36 | -455.09 |
| 11 | 40 | -505.53 |
| 12 | 44 | -555.94 |
| 13 | 48 | -606.33 |
| 14 | 52 | -656.69 |
| 15 | 56 | -707.03 |
| 16 | 60 | -757.35 |
| 17 | 64 | -807.63 |
| 18 | 68 | -857.90 |
| 19 | 72 | -908.13 |
| 20 | 76 | -958.35 |
| 21 | 80 | -1008.53 |
| 22 | 84 | -1058.70 |
| 23 | 88 | -1108.83 |
| 24 | 92 | -1158.95 |
| 25 | 96 | -1209.03 |
| 26 | 100 | -1259.09 |
| 27 | 104 | -1309.13 |
| 28 | 108 | -1359.14 |
| 29 | 112 | -1409.13 |
| 30 | 116 | -1459.09 |
| 31 | 120 | -1509.03 |
| 32 | 124 | -1558.94 |
| 33 | 128 | -1608.83 |
| 34 | 132 | -1658.69 |
| 35 | 136 | -1708.53 |
| 36 | 140 | -1758.34 |
| 37 | 144 | -1808.13 |
| 38 | 148 | -1857.89 |
| 39 | 152 | -1907.63 |
| 40 | 156 | -1957.34 |
| 41 | 160 | -2007.03 |
| 42 | 164 | -2056.69 |
| 43 | 168 | -2106.33 |
| 44 | 172 | -2155.94 |
| 45 | 176 | -2205.53 |
| 46 | 180 | -2255.09 |
| 47 | 184 | -2304.63 |
| 48 | 188 | -2354.15 |
| 49 | 192 | -2403.63 |
| 50 | 196 | -2453.10 |

| Floor | Height (m) | $PC_1$ (Pa) |
|---|---|---|
| 51 | 200 | -2502.54 |
| 52 | 204 | -2551.95 |
| 53 | 208 | -2601.34 |
| 54 | 212 | -2650.71 |
| 55 | 216 | -2700.05 |
| 56 | 220 | -2749.37 |
| 57 | 224 | -2798.66 |
| 58 | 228 | -2847.93 |
| 59 | 232 | -2897.17 |
| 60 | 236 | -2946.39 |
| 61 | 240 | -2995.58 |
| 62 | 244 | -3044.75 |
| 63 | 248 | -3093.89 |
| 64 | 252 | -3143.01 |
| 65 | 256 | -3192.10 |
| 66 | 260 | -3241.17 |
| 67 | 264 | -3290.22 |
| 68 | 268 | -3339.24 |
| 69 | 272 | -3388.24 |
| 70 | 276 | -3437.21 |
| 71 | 280 | -3486.16 |
| 72 | 284 | -3535.08 |
| 73 | 288 | -3583.98 |
| 74 | 292 | -3632.85 |
| 75 | 296 | -3681.70 |
| 76 | 300 | -3730.53 |
| 77 | 304 | -3779.33 |
| 78 | 308 | -3828.11 |
| 79 | 312 | -3876.86 |
| 80 | 316 | -3925.59 |
| 81 | 320 | -3974.29 |
| 82 | 324 | -4022.97 |
| 83 | 328 | -4071.62 |
| 84 | 332 | -4120.25 |
| 85 | 336 | -4168.86 |
| 86 | 340 | -4217.44 |
| 87 | 344 | -4266.00 |
| 88 | 348 | -4314.53 |
| 89 | 352 | -4363.04 |
| 90 | 356 | -4411.52 |
| 91 | 360 | -4459.98 |
| 92 | 364 | -4508.42 |
| 93 | 368 | -4556.83 |
| 94 | 372 | -4605.22 |
| 95 | 376 | -4653.58 |
| 96 | 380 | -4701.92 |
| 97 | 384 | -4750.24 |
| 98 | 388 | -4798.53 |
| 99 | 392 | -4846.79 |
| 100 | 396 | -4895.04 |

| Floor | Height (m) | $PC_1$ (Pa) |
|---|---|---|
| 101 | 400 | -4943.25 |
| 102 | 404 | -4991.45 |
| 103 | 408 | -5039.62 |
| 104 | 412 | -5087.76 |
| 105 | 416 | -5135.89 |
| 106 | 420 | -5183.98 |
| 107 | 424 | -5232.06 |
| 108 | 428 | -5280.11 |
| 109 | 432 | -5328.13 |
| 110 | 436 | -5376.14 |
| 111 | 440 | -5424.11 |
| 112 | 444 | -5472.07 |
| 113 | 448 | -5520.00 |
| 114 | 452 | -5567.90 |
| 115 | 456 | -5615.79 |
| 116 | 460 | -5663.64 |
| 117 | 464 | -5711.48 |
| 118 | 468 | -5759.29 |
| 119 | 472 | -5807.07 |
| 120 | 476 | -5854.84 |
| 121 | 480 | -5902.57 |
| 122 | 484 | -5950.29 |
| 123 | 488 | -5997.98 |
| 124 | 492 | -6045.65 |
| 125 | 496 | -6093.29 |
| 126 | 500 | -6140.91 |
| 127 | 504 | -6188.50 |
| 128 | 508 | -6236.07 |
| 129 | 512 | -6283.62 |
| 130 | 516 | -6331.15 |
| 131 | 520 | -6378.65 |
| 132 | 524 | -6426.12 |
| 133 | 528 | -6473.57 |
| 134 | 532 | -6521.00 |
| 135 | 536 | -6568.41 |
| 136 | 540 | -6615.79 |
| 137 | 544 | -6663.15 |
| 138 | 548 | -6710.48 |
| 139 | 552 | -6757.79 |
| 140 | 556 | -6805.08 |
| 141 | 560 | -6852.34 |
| 142 | 564 | -6899.58 |
| 143 | 568 | -6946.80 |
| 144 | 572 | -6993.99 |
| 145 | 576 | -7041.16 |
| 146 | 580 | -7088.30 |
| 147 | 584 | -7135.42 |
| 148 | 588 | -7182.52 |
| 149 | 592 | -7229.60 |
| 150 | 596 | -7276.65 |

FIG. 7

CONTROL FOR LIMITING ELEVATOR PASSENGER TYMPANIC PRESSURE AND METHOD FOR THE SAME

This application claims priority from U.S. Provisional Patent Application Ser. No. 60/954,205, filed Aug. 6, 2007, titled Tympanic Pressure Control.

FIELD OF THE INVENTION

The present application relates to elevators and elevator control systems. In particular, the present application provides a system and method for controlling an elevator car while limiting the passenger discomfort caused by pressure changes.

BACKGROUND

A passenger riding an elevator is subjected to a change in atmospheric pressure. Atmospheric air pressure can be described as the pressure at any given point in the earth's atmosphere. Atmospheric air pressure increases as an elevator travels downward, and decreases as an elevator travels upward. If these pressure changes occur too rapidly, they may cause passenger discomfort, specifically to a passenger's ears.

The ear can be divided into three sections: (1) the outer ear, (2) the middle ear, and (3) the inner ear. The middle ear is an air-filled chamber that is connected to the nose and throat through a channel called the eustachian tube. The middle ear is surrounded at respective sides by the outer ear and the inner ear. Air moves through the eustachian tube into the middle ear to equalize the pressure with the pressure of the outer ear. The middle ear contains the tympanic member, otherwise known as the ear drum. Hence, the pressure in the middle ear is often referred to as the typmanic pressure.

When an elevator travels upwards, the air pressure of the outer ear decreases with the atmospheric pressure. Compared to the outer ear, the pressure in the middle ear generally does not adjust as quickly to pressure changes. The automatic adjustment for pressure differences in the normal human ear will be referred to as "natural relief." The outer ear therefore has lower air pressure compared to the middle ear due to the middle ear's slower adjustment to pressure changes. The air pressure in the middle air remains higher until equalized. The tympanic membrane of the ear, otherwise known as the eardrum, may bulge towards the outer ear in reaction to having a higher pressure in the middle ear. If this bulge becomes too great, the person may experience discomfort, or injury to the eardrum including small hemorrhages in the ear drum, small blisters, or other injuries. In extreme cases, the eardrum may rupture, which may lead to permanent damage.

Alternatively, where a passenger descends a building, the atmospheric pressure increases in the outer ear. This pressure increase in the outer ear results in the pressure in the middle ear being lower compared to the outer ear. This pressure difference between the outer ear and the middle ear can cause the tympanic membrane of the ear to bulge inward toward the middle ear. If this bulge becomes too great, the person may experience discomfort, small hemorrhages in the ear drum, small blisters, or other injuries. In extreme cases, the eardrum may rupture, which may lead to permanent damage.

Yet further, if the person has a cold or other condition that causes partial or complete blockage of the Eustachian tube, natural relief may not be able to equalize the increased pressure difference, such that discomfort may persist for an extended period of time. Also, the sudden opening of the Eustachian tube may force a rapid pressure change in the middle ear. This sudden pressure change in the middle ear can be further transmitted to the inner ear and possibly damage the delicate mechanisms of the middle ear (i.e. the ear drum) and the inner ear.

In view of the previous discussion, it is desirable to limit the rate of the pressure changes to which passengers are exposed while riding an elevator. A system and apparatus is disclosed that will allow an elevator system to run efficiently while limiting the rate of air pressure changes to which passengers are exposed.

BRIEF DESCRIPTION OF THE DRAWINGS

It is believed the present application will be better understood from the following description taken in conjunction with the accompanying figures. The figures and detailed description that follow are intended to be merely illustrative and are not intended to limit the scope of the invention.

FIG. 7 shows a table depicting exemplary pressure information.

DETAILED DESCRIPTION

The following description of certain examples of the current application should not be used to limit the scope of the present invention as expressed in the appended claims. Other examples, features, aspects, embodiments, and advantages of the invention will become apparent to those skilled in the art from the following description. Accordingly, the figures and description should be regarded as illustrative in nature and not restrictive.

Figure 1:
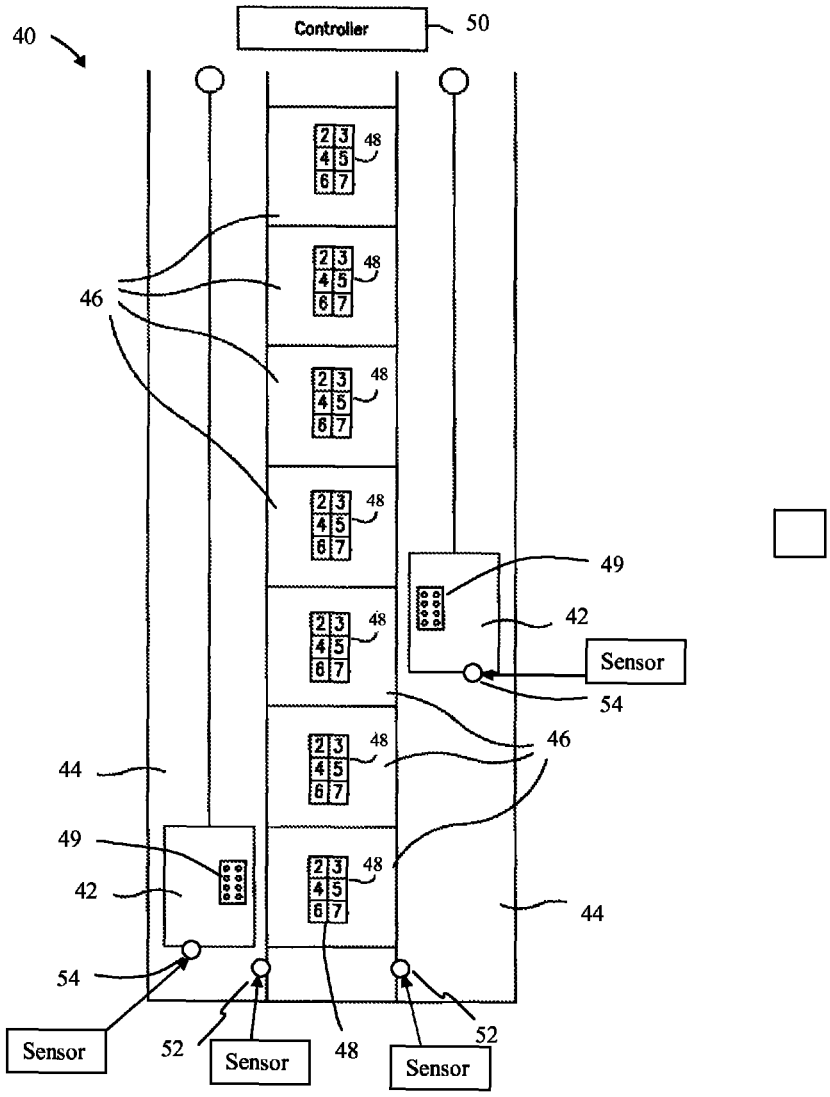
FIG. 1 depicts a schematic diagram of an exemplary elevator system.

FIG. 1 depicts an exemplary elevator system (40) including multiple elevator cars (42) positioned within a plurality of elevator shafts (44). Elevator cars (42) travel vertically within respective shafts (44) and stop at a plurality of landings (46). As depicted in the example, each of the various landings (46) includes an external destination entry device (48). Elevator cars (42) include internal destination entry devices (49). Examples of destination entry devices include interactive displays, computer touch screens, or any combination thereof. Still, other structures, components, and techniques for destination entry devices are well known and may be used. Yet further, traditional up/down call signals may be used at a landing.

As shown in the example of FIG. 1, a controller (50) communicates with elevator system (40). As will be explained in more detail hereafter, controller (50) governs the movement of elevator cars (42) to limit the air pressure differential ("PD") experienced by passenger. The movement of elevators (42), as directed by controller (50), ensures that passengers' PDs do not exceed a maximum allowable PD ("$PD_{max}$"). For purposes of this example, a passenger's PD may be defined as the pressure difference between a passenger's outer ear and middle ear.

As described below, controller (50) operates to limit passengers' PDs by adjusting the speed, direction, and jerk of elevators cars. The term elevator jerk describes the rate of change in relation to an elevator's acceleration. Controller (50) receives suitable inputs from elevator system (40) in order to appropriately adjust the speed, direction, and jerk of elevator cars. Examples of such inputs include new destination calls, the status of each elevator, pressure readings throughout the elevator shafts, and the current time. Elevator system (40) may use any suitable structure, component, and technique to obtain and send these or other inputs to controller (50). For example, elevator system (40) may use sensors (52) to gauge the air pressure in the elevator shaft. Likewise, controller (50) may use any suitable structure, component, and technique to receive such inputs.

Controller (50) communicates at least some of the inputs described above to a PD calculator (60) (see FIG. 2 and FIG. 3). PD calculator (60) uses the inputs to determine the correct settings at which to operate the elevator cars. These settings may include any combination of elevator speed, direction, and jerk, selected such that no passenger's PD exceeds $PD_{max}$. PD calculator (60) sends the settings as outputs to controller (50). Controller (50) uses the received outputs to control the speed, direction, and jerk of the elevator cars. An exemplary operation of PD calculator (60) is shown in the flowchart of FIG. 4 and described below.

Passenger information may include information specific to each individual passenger, or a group of passengers. Examples of passenger information includes call signals, destination choices, current and past pressure differentials for a passenger, elevator weight, the time when a passenger enters and exits the elevator, and so on.

Figure 6:
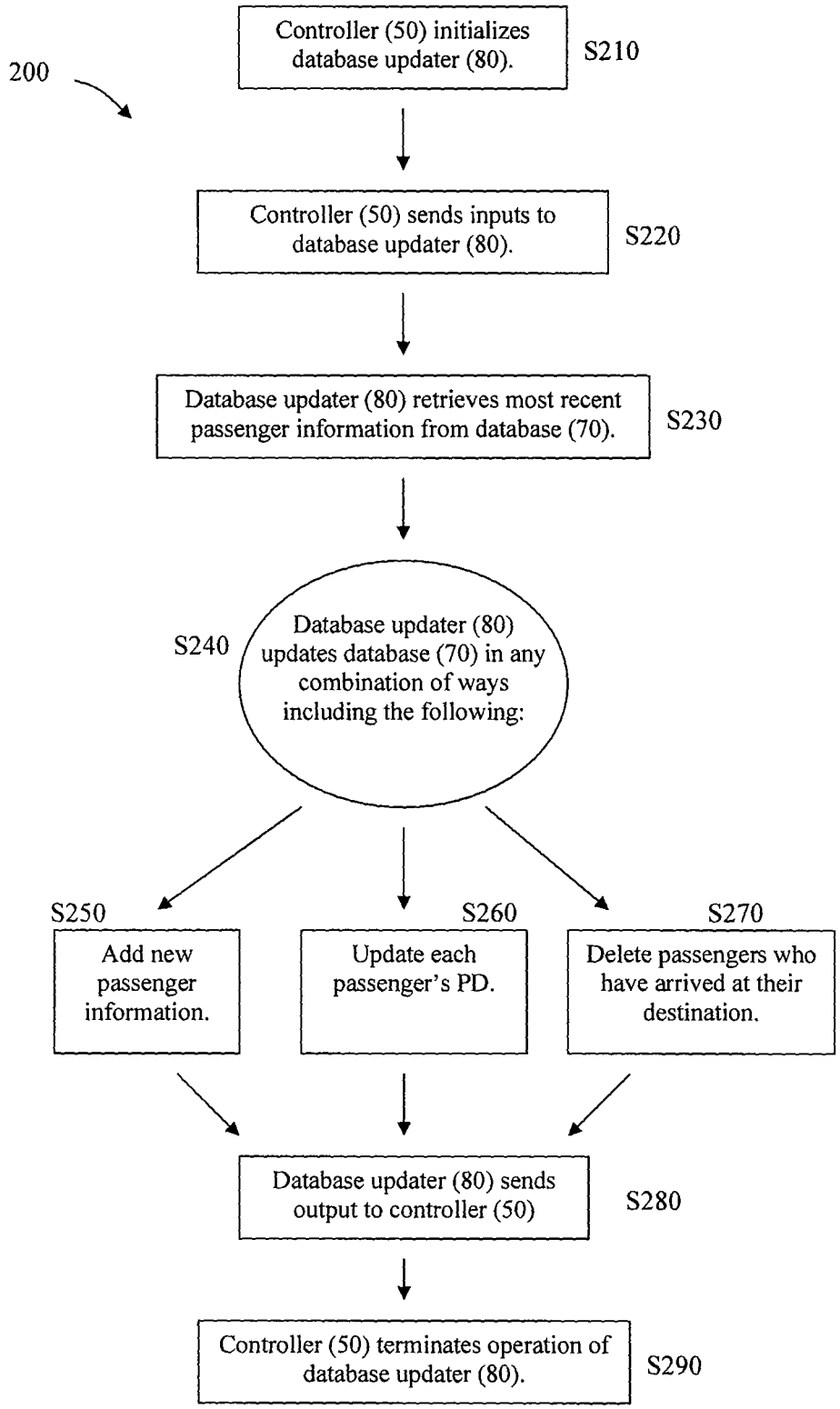
FIG. 6 depicts an exemplary flow chart for a pressure differential database and database updater.

A database updater (80), an example of which is depicted in the flowchart of FIG. 6 and described below, updates the passenger information in PD database (70). The passenger information in PD database (70) may need to be updated because passengers' PDs may change over time due to natural relief. Also, passenger information may need to be updated when a new passenger enters the elevator or a previous passenger exits the elevator.

Figure 2:
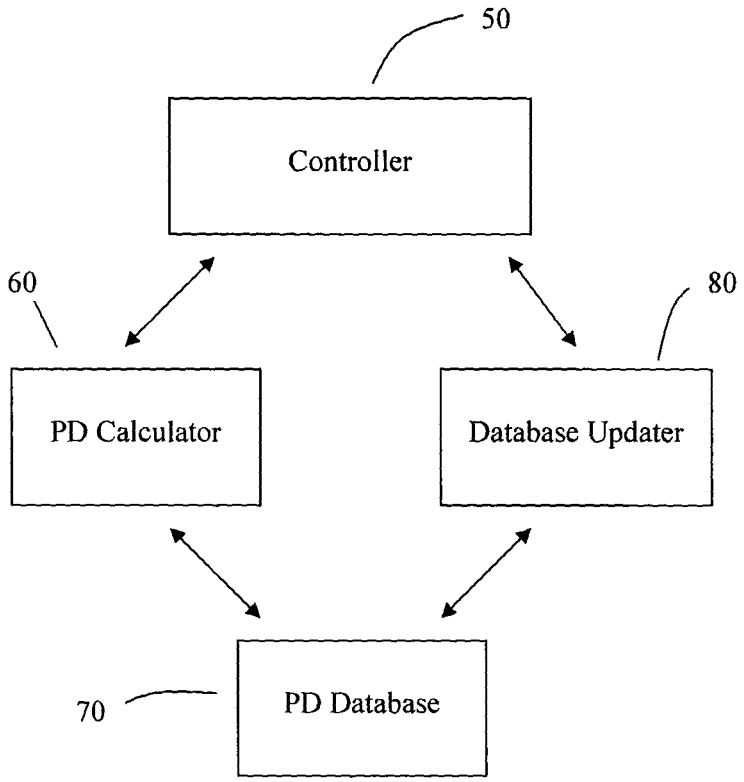
FIG. 2 depicts a block diagram for an exemplary system for controlling an elevator.

The block diagram of FIG. 2 depicts an exemplary configuration of controller (50), PD calculator (60), PD database (70) and database updater (80). In this example, controller (50) communicates inputs to PD calculator (60). PD calculator (60) also obtains inputs from database (70). PD calculator (60) uses these inputs to monitor passengers' PDs as described below and send outputs to controller (50). Controller (50) uses the outputs from PD calculator (60) to control one or more elevators so that no passenger's PD exceeds $PD_{max}$. Controller (50) communicates with database updater (80) which refreshes database (70) to contain current passenger information.

Figure 3:
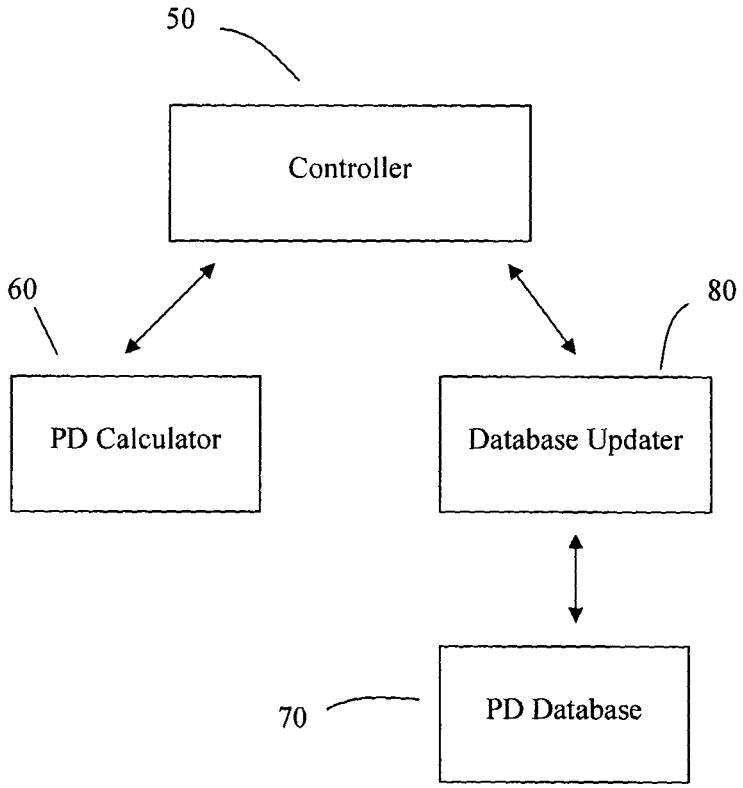
FIG. 3 depicts a block diagram for an alternative exemplary system for controlling an elevator.
Figure 4:
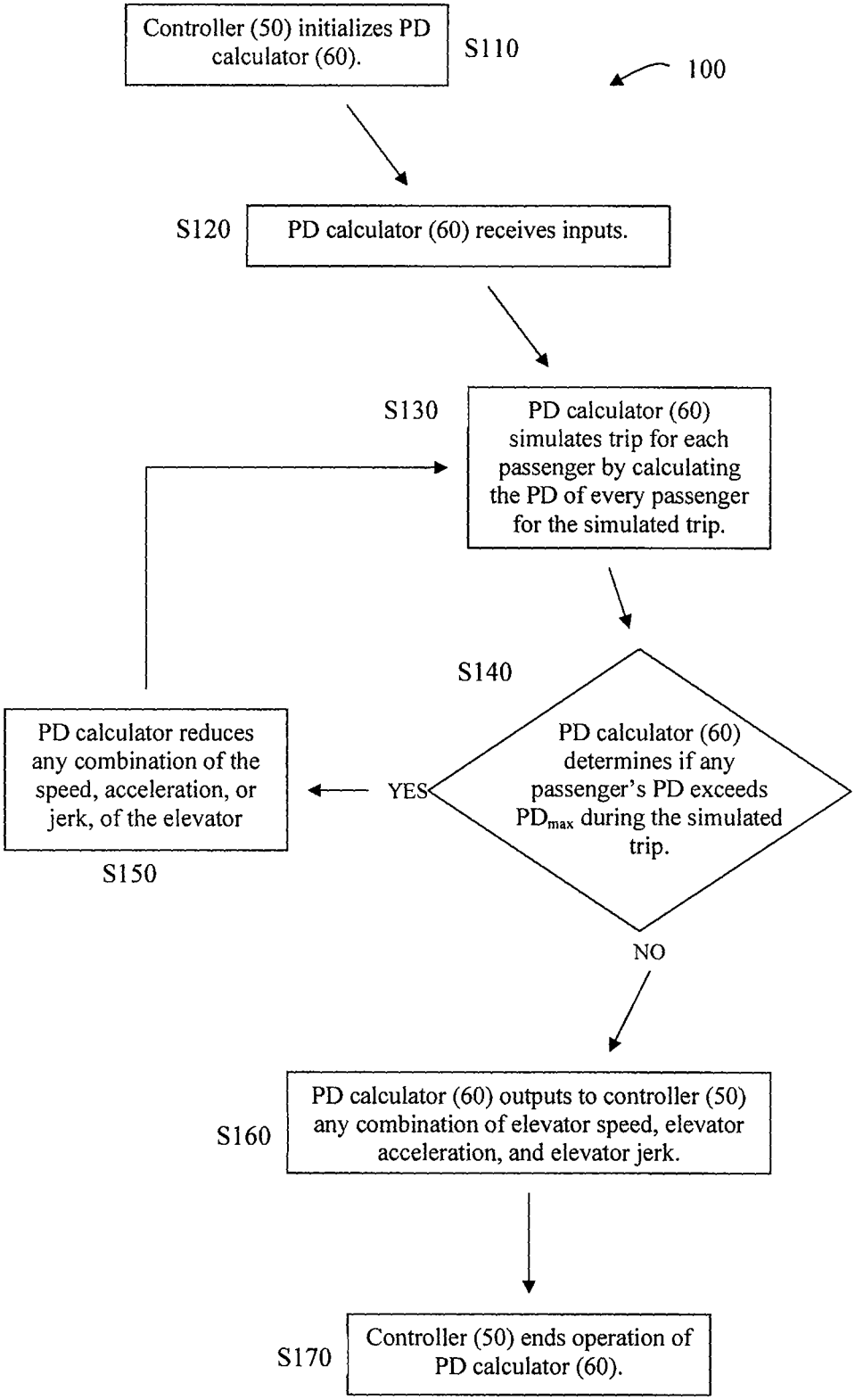
FIG. 4 depicts an exemplary flow chart for a pressure differential calculator.

In an alternative embodiment shown in the block diagram of FIG. 3, PD calculator (60) receives inputs only from controller (50). Controller (50) also communicates with database (70) via database updater (80). Controller (50) sends the passenger information received from database updater (80) to PD calculator (60). PD calculator (60) uses information from controller (50) and database (70) to formulate outputs. These outputs are sent to controller (50). Controller (50) uses the outputs to control the movement of elevators so that no passenger's PD exceeds $PD_{max}$.

Turning to the flowchart of FIG. 4, controller (50) initializes PD calculator (60) in step (S110). The initialization of controller (50) may occur at various times, for example, upon receiving a new destination call signal or after the elevator doors close. Likewise, the systems discussed herein may be incorporated into previously known methods and apparatuses for assigning or controlling elevator cars, such as that disclosed in U.S. Pat. No. 6,439,349, entitled "Method and Apparatus for Assigning New Hall Calls To One of a Plurality of Elevator Cars," issued Aug. 27, 2002, the disclosure of which is incorporated herein by reference.

Following or simultaneous with the initialization of PD calculator (60), controller (50) sends at least one input to PD calculator (60) in step (S120). For the example shown, these inputs may include, but are not limited to: the maximum and the minimum speed of the elevator, the maximum and minimum jerk of the elevator, a trip distance, passenger information including destination calls and current PD, the maximum allowable PD, the distance the elevator is to travel between the departure floor and the arrival floor, and pressure information. Pressure information may be the atmospheric pressure at various locations in the elevator shaft, the air pressure at specific floors, the air pressure differences between floors, or any combination thereof.

Controller (50) may use any suitable method and device for obtaining and sending these inputs to PD calculator (60). For example, controller (50) may be a general purpose computer pre-programmed with the maximum and minimum speed of the elevator, the maximum and minimum jerk of the elevator, pressure information, and $PD_{max}$. It will be understood that controller (50) may obtain passenger information from PD database (70). Likewise, controller (50) may obtain pressure information through sensors (52) positioned in elevator shaft (44).

Upon receiving these inputs, PD calculator (60) simulates a complete single trip for each passenger in step (S130). In the example described, a trip is defined as the elevator traveling from a first position to a second position. For example, two trips would occur where an elevator car picks up a passenger on the $150^{th}$ floor, stops at the $100^{th}$ floor for another passenger, and proceeds to the $1^{st}$ floor where both passengers depart. The first passenger trip is traveling from the $150^{th}$ floor to the $100^{th}$ floor. The second passenger trip is traveling from the $100^{th}$ floor to the $1^{st}$ floor.

In other versions, a trip may be defined as the steps necessary to carry passengers to requested destinations and address any elevator calls from waiting passengers. In this variation, a passenger trip would occur when the elevator car travels from the $150^{th}$ floor to the $1^{st}$ floor, including picking up a passenger at the $100^{th}$ floor.

Simulating a trip for each passenger is desirable because passengers may have different PD values. For example, a person entering the elevator car at the $150^{th}$ floor may have a different PD value compared to a person entering the elevator car at the $100^{th}$ floor.

Figure 5:
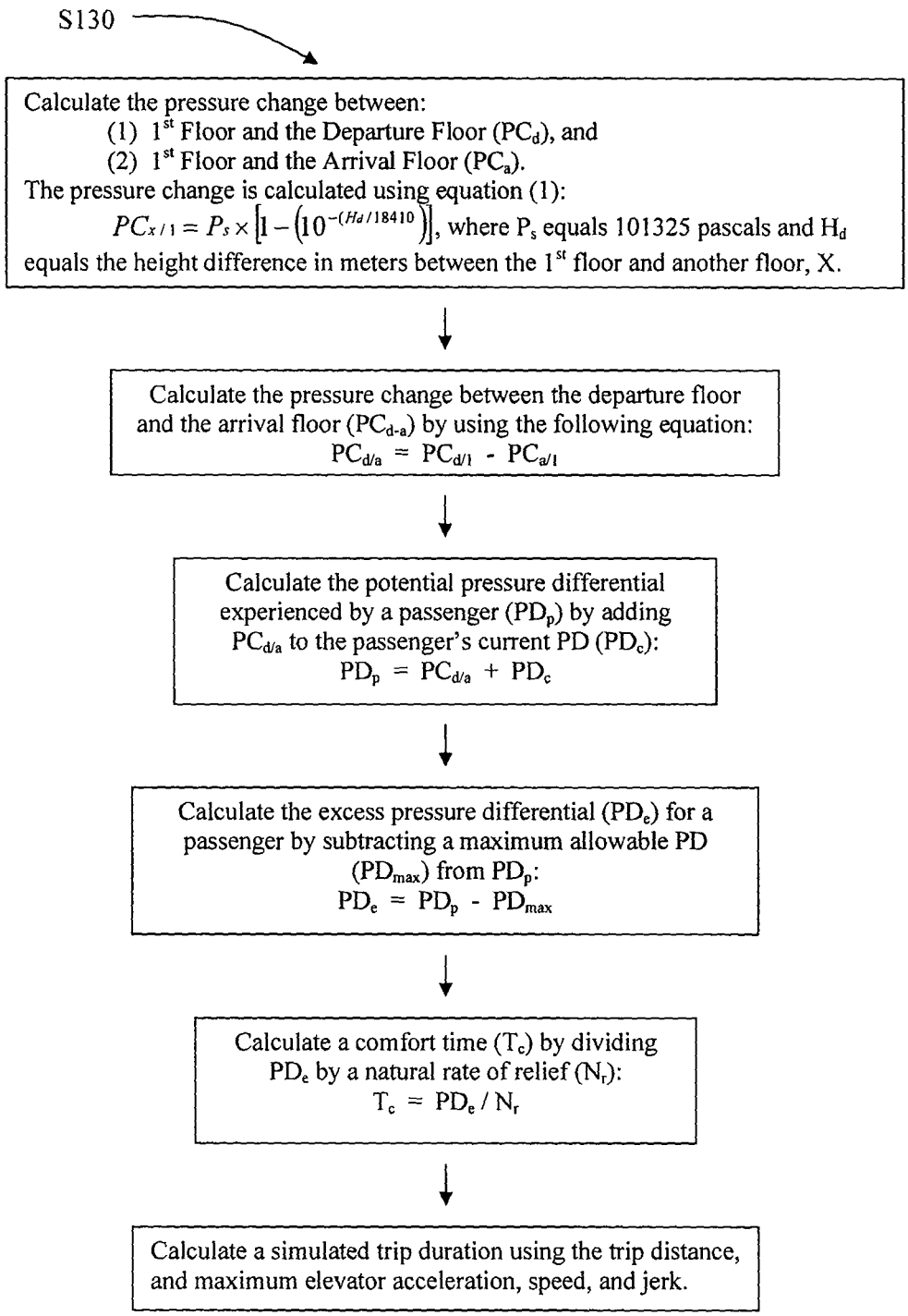
FIG. 5 depicts an exemplary flow chart for simulating a passenger's trip.

The flowchart shown in FIG. 5 depicts an exemplary operation for simulating a passenger trip, including determining the pressure change when the elevator car travels between a departure floor and an arrival floor. As discussed above, the pressure values at particular floors, or the pressure differentials between floors, may be programmed into controller (50), which in turn sends these pressure values to PD calculator (60). The pressure information may also be programmed into PD calculator (60) directly. Controller (50) and PD calculator (60) may also be provided with the ability to calculate the required pressure information.

One method for calculating this pressure change between a departure floor and an arrival floor includes determining the pressure changes between (1) the $1^{st}$ floor and the departure floor, and (2) the $1^{st}$ floor and the arrival floor. The pressure change $PC_{x/1}$ between the $1^{st}$ floor and another floor can be calculated using equation (1) below, $$PC_{x/1}=P_s\times[1-(10^{-(H_d/18410)})] \quad (1)$$

where $P_s$ represents standard atmospheric pressure of 101325 pascals, and $H_d$ represents the height difference in meters between the $1^{st}$ floor and the other floor (x). It is also assumed that the relative pressure at the first floor is zero. Equation (1) is described in the publication "Effective Atmospheric Pressure Control for Ultra-High Speed Elevator" in Proceedings of ELEVCON 2004, pp. 225-233 by Shudo, T., Y. Fujita, S. Nakagaki, M. Okamoto and A. Yamamoto.

As shown in equation (2) below, subtracting the arrival floor pressure change from the departure floor pressure change produces the pressure change ($PC_{d/a}$) experienced by the passenger during the trip.

$$PC_{d/a}=PC_{d/1}-PC_{a/1} \quad (2)$$

In equation (2), $PC_{d/1}$ represents the pressure change between the departure floor and the $1^{st}$ floor, and $PC_{a/1}$, represents the pressure change between the arrival floor and the $1^{st}$ floor.

The passenger's current pressure differential value, $PD_c$, is then added to $PC_{d/a}$ to determine the passenger's potential pressure differential, $PD_p$. The value of $PD_p$ represents the potential pressure differential which would be experienced by a passenger during the trip if no natural relief were to occur during the trip. Where no natural relief occurs, it is presumed that a passenger's PD increases or decreases directly with the pressure changes experienced by the passenger.

In practice, the passenger's current pressure differential, $PD_c$ will measure zero when the passenger enters the elevator. The passenger's $PD_c$ will change when the passenger experiences pressure changes. In some circumstances, for example where a passenger travels slowly, the passenger's $PD_c$ may still be zero even though the passenger experienced pressure changes. This will occur where the pressure differential caused by the pressure changes is offset by natural relief.

It will be understood that the passenger information stored in PD database (70) includes a $PD_c$ value for each passenger. PD calculator (60) receives this information as an input for the trip simulation calculation.

After obtaining a passenger's $PD_p$, $PD_{max}$ is subtracted from PDP to obtain the excess pressure differential value, $PD_e$, as shown in equation (3) below.

$$PD_e=PD_p-PD_{max} \quad (3)$$

The method for selecting $PD_{max}$ will be explained in more detail below.

One of the important aspects of the present method is using the passenger's natural relief to reduce the pressure differential experienced by the passenger, whether the elevator car is moving or stopped. In some elevator installations, sky lobbies are provided where natural relief can relieve pressure differences as the passenger walks from one bank of elevators to another. However, the present method uses the passenger's natural relief which occurs while the elevator car is stopped to pick up or discharge passengers to reduce the pressure difference experienced by the passengers' ears as a factor to optimally control the operation of the elevator, and thereby minimize the total passenger travel time. For example, the speed of the elevator between destinations can be increased since the passengers will be starting from a lower initial pressure difference, and can therefore experience a higher pressure change per unit time, provided a comfortable ear pressure differential is not exceeded.

Thus it will be understood that to ensure that no passenger's $PD_e$ exceeds zero, the elevator will need to travel at a speed, acceleration, or jerk to provide the time necessary for natural relief to equalize or at least reduce the passenger's $PD_e$. Accordingly, the present method contemplates that elevator run at an acceleration, speed, and/or jerk such that a passenger's PD approaches but does not exceed $PD_{max}$. This requires equalizing $PD_e$.

Equalizing $PD_e$ can be accomplished by calculating a comfort time, $T_c$. The comfort time, $T_c$, represents a period of time over which $PD_e$ is equalized. More specifically, this comfort time represents the time necessary to equalize $PD_e$ based on a rate of natural relief, $N_r$. The natural relief rate can be estimated based on pressure change values used by pressurized airline cabins to insure passenger comfort. As is generally understood, while climbing or descending, the automatic pressurization system the rate of altitude change within the airplane cabin is limited to a comfortable range, often around 350 to 450 feet per minute. Using equation (1) above, the lower end of this range, 350 feet per minute (1.75 m/sec.), equates to a pressure change of about 22 pascels/sec.

$T_c$ can be calculated as shown in equation (4):

$$T_c=\frac{PD_e}{N_r} \quad (4)$$

After calculating $T_c$ for each passenger, the trip time is then calculated using the maximum speed, acceleration, and jerk of the elevator.

After simulating a value for $T_c$ in step (S130), PD calculator (60) determines in step (S140) whether any passenger's PD exceeds $PD_{max}$ during the trip. This is determined by examining whether the estimated duration of the simulated trip is less than any passenger's $T_c$. That is, a passenger's PD will exceed $PD_{max}$ during the trip if the simulated trip duration is less than $T_c$. A passenger's PD will not exceed $PD_{max}$ during the trip if the simulated trip duration is greater than $T_c$. Alternatively, PD calculator (60) may only compare the simulated trip duration with the largest $T_c$ value where the elevator contains multiple passengers.

Where it is determined that at least one passenger's PD exceeds $PD_{max}$, PD calculator (60) performs step (S150) and alters at least one variable input of the simulated trip so as to increase the trip duration so it is equal to or greater than $T_c$. For example, in order to insure that no passenger's PD exceeds $PD_{max}$, the elevator's speed, acceleration and/or jerk may be reduced. Any suitable methods and techniques may be used to vary the inputs needed to increase the simulated trip duration to a value equal to or greater than $T_c$.

After altering at least one variable input in step (S150), PD calculator (60) either partially or completely repeats step (S130). For example, PD calculator (60) may be configured to only re-calculate the simulated trip duration. Alternatively, PD calculator (60) may be configured to only repeat step (S130) for the passenger whose PD exceeded $PD_{max}$.

After iteratively repeating step (S130), PD calculator (60) repeats step (S140) to determine whether any passenger's PD exceeds $PD_{max}$ by comparing the simulated trip duration with each passenger's $T_c$. If the simulated trip duration is less than any passenger's $T_c$, steps (S150) and (S140) are repeated. PD calculator (60) continues to repeat steps (S150) and (S140) until a determination is made that the simulated trip duration is equal to or greater than every passenger's $T_c$. Upon making a determination that no passenger's PD exceeds $PD_{max}$, PD calculator (60) outputs the speed, acceleration and jerk values to controller (50) in step (S150).

Alternatively, or in addition to having PD calculator (60) simulate trips, PD calculator (60) may be configured with the ability to calculate elevator speed, acceleration, and jerk based on the target travel time, $T_c$, and distance to be traveled. Using this approach may prevent PD calculator (60) from simulating trips until an adequate value for the car's speed, acceleration, and jerk are found. For example, a passenger enters the elevator at the $120^{th}$ floor and selects the lobby as a destination. The distance between the $120^{th}$ floor and the $1^{st}$ floor is 486 meters. PD calculator (60) calculates a $T_c$ for the passenger of 88.8 seconds. PD calculator (60) then would use available elevator speeds, accelerations, and/or jerk capabilities to create a trip for this passenger lasting 88.8 seconds. It will be observed that this methodology permits the system to reduce or optimize the total travel time by taking into account the natural relief of the passenger, while insuring passenger comfort. The average velocity necessary for traveling 486 meters in 88.8 seconds is 5.47 m/s. Numerous devices, systems, and techniques such as artificial intelligence are well known and may be used to create a trip for a passenger lasting a time equal to or greater than $T_c$.

Controller (50) may also use the output from PD calculator (60) to take into account the delays associated with picking up waiting passengers. This embodiment would be especially useful for elevator systems having multiple elevator cars. In particular, this embodiment (as well as others described herein) may be implemented using the system described in U.S. Pat. No. 6,439,349, titled "Method and Apparatus for Assigning New Hall Calls To One of a Plurality of Elevator Cars," issued Aug. 27, 2002. In this embodiment, controller (50) analyzes the degree to which that car's speed, acceleration or jerk may be limited as a result of the current PDs of that car's passengers. Controller (50) then utilizes that information to assess which car should be assigned to particular waiting passengers, based on their destinations. For example, controller (50) may allocate certain waiting passengers to a car already delayed because of the PD levels associated with one or more of that car's passengers. This improves the efficiency of the operation of the overall elevator system compared to allocating waiting passengers to other cars where travel is not limited by the passengers' PDs.

A system of this kind may be implemented in a variety of ways. For example, controller (50) may be programmed to recognize when multiple cars may potentially arrive at a call signal at about the same time. In this case, each elevator may be assigned a PD level representative of the passenger for that car having the highest PD or $T_c$. When multiple cars are more or less equally capable of responding to the elevator call, controller (50) may calculate an estimated time to inferred destination (ETID) as described in U.S. Pat. No. 6,439,349. This ETID represents the estimated time for a particular elevator car to reach its final destination. Controller (50) may use the stoppage time associated with allowing passengers to enter and depart the elevator car in calculating the ETID.

Controller (50) may then use the ETID so calculated to determine which elevator car should address a particular call signal. For example, an elevator car stopping for a waiting call signal would unnecessarily delay passengers which are not PD limited, since that car could travel at maximum speed and/or acceleration. Alternatively, PD limited passengers in a second elevator responding to the same call signal would be unnecessarily delayed already as the need for the car to travel or accelerate more slowly due to at least one passenger's PD. Accordingly, in this example, it would be more efficient for controller (50) to direct the second car to respond to the call signal as its passengers are already delayed due to at least one passenger's PD. Further, allowing the second car to address the call signal will permit natural relief to equalize the passengers PDs such that the second car may travel more quickly to its next destination.

More specifically, the following discloses an exemplary embodiment for assigning elevator cars by calculating the call cost value ("CC") (as disclosed in U.S. Pat. No. 6,439,349) in an elevator system having an external destination entry device wherein the embodiment factors in the value of at least one passenger's PD. As disclosed in U.S. Pat. No. 6,439,349, the CC for an elevator is calculated using equation (5) below:

$$CC = \sum_{k=1}^{n} SDF_k + ETD \tag{5}$$

wherein SDF equals the system degradation factor and ETD stands for estimated time to destination, wherein each car has the a quantity of (n) existing car and hall calls (k). The value of CC is calculated respectively for each elevator car in an elevator system. The elevator car with the lowest CC is assigned to respond to an elevator car.

The value for SDF equals the time required for a car to respond to a call signal. Various time periods may be predicted for this amount. For example, the elevator may allocate an increased amount of time to respond to a call signal during peak hours of elevator use due to the increased time required for larger numbers of individuals to enter the elevator. As evidence from equation (5), a higher value for SDF reduces the chance that an elevator is assigned to respond to an elevator car.

However, in situations where an elevator's travel is limited due to a passenger's PD, it may be more beneficial for the elevator car to be allotted an SDF of zero, or some other value factoring in a passenger's PD. Stopping to respond to a call signal allows passengers in an elevator car to equalize at least a portion of their respective PD. This equalization caused by natural relief may allow the elevator car to travel faster during its remaining travels compared to when its travels where limited by at least one passenger's PD. In some circumstances, the elevator car may even reach its remaining destinations at the same time as it would have when it originally departed despite stopping to respond to a call signal.

For example, assume two passengers enter an elevator at the $149^{th}$ floor. The two passengers select the lobby as their destination on an external destination entry device. The elevator calculates the ETD as 60 seconds without stopping when traveling from the $149^{th}$ floor to the lobby. However, the elevator could travel more quickly to the lobby if not for at least one passenger's PD exceeding $PD_{max}$ during the trip. A third individual at the $100^{th}$ floor presses the external destination entry device when the elevator begins departing from the $149^{th}$ floor. The third individual is traveling to the $75^{th}$ floor. Generally, the value of SDF could be calculated using the time necessary for the elevator to respond to the call signal at the $100^{th}$ floor and stop at the $75^{th}$ floor. This value for SDF could be used to calculate CC for the elevator, and hence help determine which elevator is assigned to respond to a call signal. In one system described in U.S. Pat. No. 6,439,349, the value for SDF for each of the two passengers would be 20 seconds based on 10 seconds to stop respectively at the $100^{th}$ floor and the $75^{th}$ floor.

However, an alternative system for calculating CC may be used where the system factors in a value of SDF reflecting at least one passenger's PD limiting the elevator's speed and/or acceleration. Natural relief occurs when the elevator stops and equalizes passengers' PDs. Equalizing a passenger's PD may permit the elevator car to travel faster to overcome time lost for responding to call signals. It is seen in the example above that the system may send the elevator car carrying the two passengers to pick up the third individual at the $100^{th}$ floor and stop at the $75^{th}$ floor. When the elevator stops at each floor, natural relief equalizes at least some value of the passengers' PDs. Equalizing a portion of the passengers' PDs may permit the elevator to reach the lobby floor with the two passengers in 60 seconds because the elevator car may travel more quickly due to natural relief equalizing passengers' PDs.

Factoring a passenger's PD into the calculation of CC could occur in several ways. First, the SDF for an elevator's car could be zeroed when calculating CC. However, any other suitable method may be used. For example, a different SDF value may be calculated measuring the overall effect of stopping to respond to a call signal. This value may equal the difference between the ETD where no stops occur and the elevator's travel is limited by a passenger's PD, and the ETD where the elevator responds to a call signal but the elevator's travel is not limited by a passenger's PD.

Assume in the example above that the elevator may travel from the $149^{th}$ floor to the lobby in 60 seconds without stopping. However, its travel is limited due to a passenger's PD during this non-stop trip lasting 60 seconds. Otherwise, the trip would only last 45 seconds. Assume that the elevator may travel from the $149^{th}$ floor to the lobby in 65 seconds when the elevator stops to pick up the third passenger at the $100^{th}$ floor and stop at the $75^{th}$ floor where each stop lasts 10 seconds. Normally, SDF would equal 20 seconds. However, a different value of SDF could be measured that equals 5 seconds. This value would reflect the ability of the elevator to travel at an increased speed due to the effect of natural relief equalizing passengers' PDs when the elevator stopped to respond to the call signal. Overall, the different equation that could be used to calculate a value for CC is seen below in equation (6) where TE reflects the time gained by traveling at a greater speed due to passengers' PD no longer limiting the elevator speed compared to when the elevator speed is limited by a passenger's PD.

$$CC = \sum_{k=1}^{n} SDF_k + (ETD - TE) \tag{6}$$

TE in the example above equals 15 seconds. More specifically, TE reflects the value equaling the difference between the non-stop travel time unhindered by passengers' PD (45 seconds) and the non-strop travel time hindered by passengers PD (60 seconds). It will be understood that the value of TE may never exceed ETD. Otherwise, the difference between ETD and TE will be provided a value of zero.

An example of a PD calculator (60) utilizing the flowchart of FIG. 4 will now be described for an elevator in a building having 150 floors. In this example, it will be assumed that each floor is 4 meters in height. FIG. 7 illustrates for each floor the respective height and pressure change in relation to the $1^{st}$ floor, ($PC_{x/1}$). Here the $1^{st}$ floor is assumed to have a relative pressure of zero.

In this example, assume that Passenger A enters an empty elevator on the $150^{th}$ floor, and that the passenger had previously selected the $1^{st}$ floor as the destination on the destination entry device. As Passenger A enters the elevator, the same elevator receives a call signal from the $89^{th}$ floor. The elevator then descends to the $89^{th}$ floor in response to the call signal. Passenger A's PD has now increased from zero to 2,207 pascals during the trip to the $89^{th}$ floor.

Passenger B then enters the elevator at the $89^{th}$ floor. Passenger B previously selected the $1^{st}$ floor as the destination on the destination entry device. After updating database (70) as described below, controller (50) initializes PD calculator (60). Controller (50) sends inputs to PD calculator (60) including passenger information, and pressure information as shown in FIG. 7. For this example, it is assumed that the maximum elevator speed, acceleration, and/or jerk are programmed in PD calculator (60). PD calculator (60) then simulates a prospective trip for Passenger A and Passenger B from the $89^{th}$ floor to the $1^{st}$ floor.

First, PD calculator (60) calculates the potential pressure differential, $PD_p$, that would be experienced by the passengers during the simulated trip. Using equation (1), PD calculator (60) adds the passenger's current pressure differential, $PD_c$, (2,207 pascals for Passenger A and zero for passenger B, since Passenger B entered the elevator at the 89th floor), to the pressure change between the $89^{th}$ floor and the $1^{st}$ floor, $PC_{89/1}$ (4,363 pascals as shown in FIG. 7.) Therefore, Passenger A's $PD_p$ is 6,570 pascals and Passenger B's $PD_p$ is 4,363 pascals.

Each passenger's pressure differential excess, $PD_e$, is then calculated by subtracting the passenger's $PD_p$ from $PD_{max}$ as shown in equation (3). It is assumed that $PD_{max}$ is 4,000 pascals for this example, as described below. Therefore, Passenger A's $PD_e$ is 2,570 pascals, and Passenger B's $PD_e$ is 363 pascals. It will be understood that both Passenger A and B's $PD_e$ should be equalized over the trip, otherwise, one or both of the passenger's PD will exceed $PD_{max}$.

As described above, the comfort time, $T_c$, provides the time necessary for the pressure differential $PD_e$ to equalize due to natural relief. Using equation (4), $T_c$ for passenger A and B respectively are about 115 seconds and 16 seconds, assuming that natural relief occurs at about 22 Pa/s. Accordingly, in this example, it will be understood that Passenger A's $T_c$ limits the elevator's traveling speed compared to Passenger B's $T_c$.

PD calculator (60) then simulates a trip duration from the $89^{th}$ floor to the $1^{st}$ floor using the maximum elevator acceleration, speed, and/or jerk. Passenger A's PD exceeds $PD_{max}$ if the calculated trip duration is less than Passenger A's $T_c$. PD calculator (60) then reduces the elevator acceleration, speed, and/or jerk, or any combination thereof and recalculates the simulated trip duration until the simulated trip duration is greater than Passenger A's $T_c$ value of about 115.8.

It will be understood that values may be chosen for $PD_{max}$, although it is preferred that $PD_{max}$ be in the range of 100 pascals to 4,000 pascals. Generally, ear pressure is automatically vented through the Eustachian tubes when the pressure differential reaches about 4,000 pascals. However, the eardrum also reaches the limit of its flexibility with a pressure differential of 4,000 pascals. And some individuals may experience discomfort when the pressure differential reaches 1250 pascals. In any event, larger differential pressure levels may cause passenger discomfort, or even ear damage. Generally, it is also advisable to have a $PD_{max}$ greater than 100 pascals because individuals generally do not notice pressure differentials less than 100 pascals. It will be further understood that these values may be affected by individual characteristics, such as blockages to the Eustachian tube caused by illness, etc.

Other factors may also affect the selection of $PD_{max}$ including the height of the building in which the elevator operates, the range of the floors the elevator operates within, the average ride length, the number of other elevators in the system, whether an elevator will travel nonstop to a destination, and the range of speeds for an elevator. Thus, choosing a value for $PD_{max}$ involves balancing operation of the elevator in an efficient manner while minimizing the potential discomfort caused to passengers. Generally, and while not a limiting factor, it is preferred to have a $PD_{max}$ of no more than about 4000 pascals.

In the exemplary block diagram shown in FIG. 2, database updater (80) refreshes database (70). Refreshing and updating are used interchangeably herein. Refreshing database (70) ensures that PD calculator (60) receives the necessary information to accurately simulate a trip for each passenger. FIG. 6 depicts an exemplary embodiment for refreshing database (70).

In the exemplary embodiment shown, controller (50) initializes database updater (80) in step (S210). Controller (50) may send inputs to database updater (80) simultaneously with initializing it, or in a separate step (S220). The inputs sent by controller (50) may include, but are not limited to, new destination calls, the status of all elevators in a system, the previous movements by all elevators subsequent to the most recent update of database (70), and the current time. For this example, the status of an elevator may be described as its location, speed, and direction.

After receiving the inputs in step (S220), database updater (80) retrieves the most recent passenger information (S230) and refreshes database (70) as shown in steps (S250), (S260), and (S270).

As one alternative illustrated in step (250), database updater (80) adds new passengers to database (70) where an input received is a new call signal. For purposes of this example, each passenger added to database (70) will be assigned an initial PD of 0. Database updater (80) may also add new passengers to database (70) based on destination call information.

Each passenger may be assigned the destination selected where passengers select the same destination. Passengers may be assigned to different groups where multiple destinations are selected. For example, if two individuals select different destinations, each passenger is assigned that passenger's respective destination. If multiple passengers select only a single destination, the passengers may be assigned to a single group designated by the destination selected.

Where passengers select destinations using an internal destination entry device, at least one passenger is assigned that destination. Where the system is unable to determine a passenger's destination, database updater (80) may assign a default destination, for example the highest floor where the elevator is traveling upwards, or the lowest floor where the elevator is traveling downwards. Alternatively, the default destination may comprise the highest selected destination where the elevator is traveling upward, or the lowest selected destination where the elevator is traveling downward.

Weight sensors (54) may also be incorporated into the elevator system, as shown in FIG. 1, which communicate with controller (50). Sensors (54) are intended to sense changes in the weight of the elevator car, caused by passengers entering or exiting the car. Sensors (54) may also be used to sense weight changes to determine which passengers or groups of passengers exit an elevator car. For example, if the elevator car weight increases by 325 pounds after responding to a single destination call, controller (50) may determine whether the elevator car weight is reduced by 325 pounds at the selected destination. Thus if the weight decreases by 325 pounds at the selected destination, controller (50) may conclude that all passengers entering at the previously call signal departed the elevator car at that destination.

Using sensors (54) in this manner would also be useful where passengers enter an already occupied elevator already car. For example, assume that two passengers enter an elevator at the $80^{th}$ floor where the elevator is already carrying a passenger from the $100^{th}$ floor to the 1st floor. The two $80^{th}$ floor passengers select the $20^{th}$ floor as a destination using an external destination entry device. Sensors (54) may be used to monitor the increase in elevator weight when the two $80^{th}$ floor passengers enter the elevator. If the weight decreases by this amount at the $20^{th}$ floor, controller (50) will conclude that both $80^{th}$ floor passengers departed from the elevator. If the weight decreases by a smaller amount, controller (50) will conclude that one or more of the $80^{th}$ floor passengers remained on the elevator. Controller (50) may also assign a default value to the passenger who entered at the $80^{th}$ floor but remains on the elevator.

Database updater (80) also updates each passenger's past PD ($PD_o$) in step (S260) using inputs received in step (S220). The inputs may include the most recent passenger information, the elevator's trip information since the last update, and the time transpired since the last update.

Pressure information may be permanently stored in database updater (80), for example as the table shown in FIG. 7. Where the pressure information is not permanently stored, PD updater (80) may use equation (1) to calculate the appropriate pressure changes between floors, e.g., the pressure changes between (1) the last departure floor and the $1^{st}$ floor ($PC_{d/1}$); and (2) the arrival floor and the $1^{st}$ floor ($PC_{a/1}$). PD updater (80) uses $PC_{d/1}$ and $PC_{a/1}$ to calculate the pressure change between the departure floor and the arrival floor ($PC_{a/d}$). $PC_{a/d}$ represents the pressure change experienced by a passenger during a past trip. An exemplary method for calculating $PC_{a/d}$ is shown below as equation (7) below, where $H_2$ is the height difference between the arrival floor and the $1^{st}$ floor, and $H_1$ is the height difference between the departure floor and the $1^{st}$ floor.

$$PC_{a/d}=PC_{a/1}-PC_{d/1}, \tag{7}$$

where $PC_{a/1}=P_s\times[1-(10^{-(H_2/}18410)]$ and $PC_{d/1}=P_s\times[1-(10^{-(H_1/84})]$ By way of example, assume that Passenger C entered the elevator at the $146^{th}$ floor to travel to the first floor. The elevator stops at the $101^{st}$ floor to pick up Passenger D, whose destination is also the $1^{st}$ floor. Database updater (80) updates Passenger C's information to reflect stopping at the $101^{st}$ floor. Database updater (80) also calculates Passenger C's $PC_{101/146}$ as 2,145 pascals.

Database updater (80) uses the time traveled, $T_t$, to lower $PC_{a/d}$ because of natural relief. $PD_f$, the pressure differential experienced by a passenger since the last update of database (70) can be calculated using equation (8):

$$PD_f=PC_{a/d}-(T_t\times N_r) \tag{8}$$

where $N_r$=22 Pa/s as described above.

For the example of Passenger C, if the elevator required 20 seconds to travel from the $146^{th}$ floor to the $100^{th}$ floor, natural relief equalized 440 pascals during this time. $PD_f$ is thus 1,705 pascals.

Using this approach, a value for $PD_f$ can be calculated for each passenger. It will be observed that a passenger's PD increases where $PD_f$ is a positive value, and decreases where $PD_f$ is a negative value.

The current pressure differential ($PD_c$) for a particular passenger can be calculated by adding $PD_f$ to the passenger's previous PD value, $PD_o$. This calculation is described in equation (9) below.

$$PD_c=PD_o+PD_f \tag{9}$$

In the example above, Passenger C's $PD_o$ is zero because that passenger entered the elevator at the $146^{th}$ floor, the starting floor. Therefore, Passenger C's $PD_c$ is 1,705 pascals, the value of Passenger C's $PD_f$. This $PD_c$ value for Passenger C is used during the trip simulation by PD calculator (60).

Finally, database updater (80) communicates with database (70) to delete passengers from database (70) as shown in step (S270). In an exemplary embodiment, database updater (80) assumes that destination entries represent a passenger's departure floor, even though a passenger may change his or her mind after the elevator begins traveling. In another example, inputs to database updater (80) may include the weight of the elevator car. As described above, database updater (80) may utilize weight changes to monitor passengers' entrances to and departures from the elevator car.

As shown in FIG. 6, after updating database (70), database updater (80) outputs the passenger information to database (70) in step (S280). Database updater (80) uses this output as a reference point when subsequently updating database (70). Database updater (80) may also output the passenger information to controller (50). Controller (50) sends the information to PD calculator (60) or acts as a backup source for the passenger information. It may not be necessary for the database updater (80) to output updated passenger information to controller (50) where PD calculator (60) retrieves updated passenger information directly from database (70).

In further embodiments, the update of database (70) may be automatic. For example, database (70) may communicate directly with controller (50) or PD calculator (60) to obtain inputs to update itself. In a further embodiment, the updates of database (70) may be periodically sent to controller (50), PD calculator (60), and database updater (80). For example, PD calculator (60) may receive updates of database (70) each time the elevator stops. In another example, PD calculator (60) may receive updates of database (70) during certain time intervals. Controller (50) may also determine when updates of database (70) are sent to PD calculator (60). Alternatively, PD calculator (60) may retrieve updates from database (70). In a further example, PD calculator (60) may receive updates of database (70) at both elevator stops and during predetermined periodic time intervals.

Figure 8:
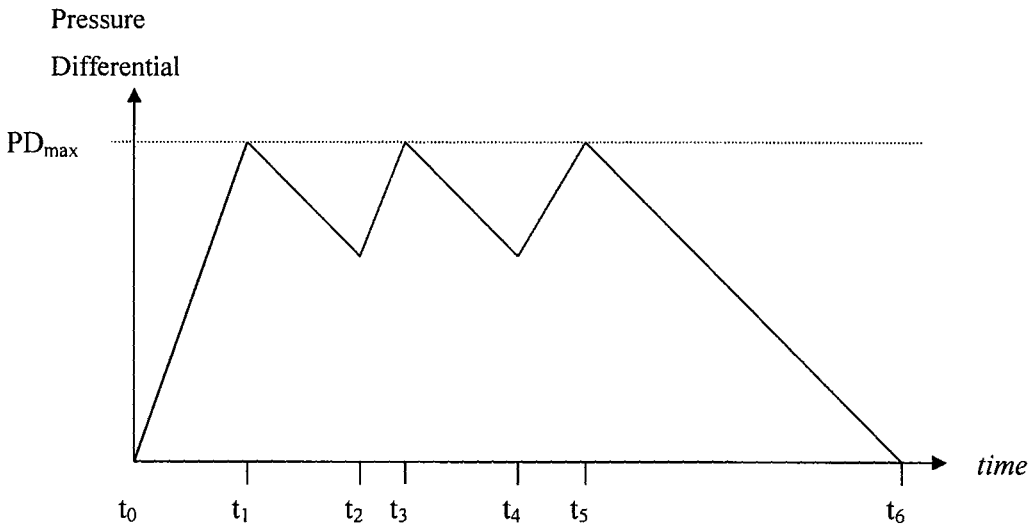
FIG. 8 shows a chart depicting an exemplary air pressure differential experienced by a passenger descending in an elevator car.

FIG. 8 shows an example of the change in a single passenger's PD where the elevator car descends beginning at time to as quickly as possible without the passenger's PD exceeding $PD_{max}$. As depicted in this illustration, the elevator car makes three stops at times $t_1$, $t_3$, and $t_5$, for example to pick up waiting passengers. Times $t_2$ and $t_4$ represent the points when the elevator resumes traveling. The passenger's PD, as depicted, reaches $PD_{max}$ at times $t_1$, $t_3$, and $t_5$. Therefore, this example illustrates an efficient method for operating the elevator system where the elevator travels as quickly as possible from one stop to the next without the passenger's PD exceeding $PD_{max}$. It will be noted that here the term "trip" is used to describe the elevator's travels from time $t_0$ to $t_1$, from time $t_2$ to $t_3$, and from time $t_4$ to $t_5$.

As further depicted in the example of FIG. 8, natural relief of the passenger's PD occurs while the elevator is stopped beginning at times $t_1$, $t_3$, and $t_5$. In this example, natural relief lowers a passenger's PD at a slower rate compared to the rate by which a passenger's PD increases during movement of the elevator.

To more specifically describe the example shown in FIG. 8, a passenger enters an elevator whereupon the elevator begins descending at time $t_0$. The elevator continues descending from time $t_0$ to $t_1$. This would constitute a first trip. The elevator stops at time $t_1$. For optimum operations, the elevator travels at the greatest speed possible between times $t_0$ and $t_1$ so that the passenger's PD reaches $PD_{max}$ at time $t_1$ without exceeding $PD_{max}$. The elevator then remains stationary from time $t_1$ to $t_2$, whereupon the passenger's PD decreases due to natural relief. During this period, other passengers may enter or exit the elevator. It will thus be observed that the passenger's natural relief while the elevator car is stopped is used as a factor to optimally control the operation of the elevator, and thereby minimize the total passenger travel time.

In this example, the elevator continues descending at time $t_2$ to arrive at its next stop. This would constitute the second trip. For optimum operation, the elevator descends at the greatest speed possible between times $t_2$ and $t_3$ so that the passenger's PD reaches $PD_{max}$ at time $t_3$, but without exceeding $PD_{max}$. After the elevator stops at time $t_3$, the elevator is then stationary from time $t_3$ to $t_4$ whereupon the passenger's PD again decreases due to natural relief.

When the elevator begins descending again at time $t_4$, for optimum operation the elevator travels at the greatest speed possible between times $t_4$ and $t_5$ so that the passenger's PD reaches $PD_{max}$ at time $t_5$. This would constitute the third trip. At time $t_5$, the elevator stops once again whereupon the passenger exits the elevator. From time $t_5$ to $t_6$, the passenger's PD will then decrease to zero due to natural relief as the passenger is no longer experiencing external pressure changes.

Having shown and described various embodiments, further adaptations of the methods and systems described herein may be accomplished by appropriate modifications by one of ordinary skill in the art without departing from the scope of the invention defined by the claim below. Several of such potential modifications have been mentioned, and others will be apparent to those skilled in the art. For instance, the examples, embodiments, ratios, steps, and the like discussed above may be illustrative and not required. Accordingly, the scope of the present invention should be considered in terms of the following claims and is understood not to be limited to the details of structure and operation shown and described in the specification and drawings.

What is claimed is:

1. An elevator controller for controlling an elevator system having at least one elevator car for vertically conveying passengers, said elevator controller (a) programmed to operate said at least one elevator car to move vertically without pressure differential experienced by a passenger's ear exceeding a maximum pressure differential value; and (b) programmed to simulate an elevator trip between an initial location and a destination location for at least one elevator passenger, to calculate a pressure differential value representative of the pressure difference between a passenger's middle and outer ear at one or more points during the simulated trip, and to establish values for one or more of the speed, acceleration or jerk of the elevator car during the simulated trip so that the calculated pressure differential value does not exceed the maximum pressure differential value as the elevator car travels from the initial location to the destination location during the simulated trip, and to operate the at least elevator car in accordance with the established values.

2. The elevator controller of claim 1 wherein the elevator controller is programmed to calculate a pressure differential value representative of the pressure differential which would be experienced by a passenger's ear at one or more vertical locations associated with elevator car travel, and to establish one or more of the speed, acceleration or jerk of the at least one elevator car so that the calculated pressure differential value does not exceed the maximum pressure differential value.

3. The elevator controller of claim 2 wherein the elevator controller is programmed to calculate a pressure differential value for more than one passenger.

4. The elevator controller of claim 3 wherein the elevator controller is programmed to operate said at least one elevator car to move vertically without pressure differential experienced by any passenger's ear exceeding the maximum pressure differential.

5. The elevator controller of claim 2 wherein the elevator controller is programmed to calculate a single pressure differential value for a group of passengers.

6. The elevator controller of claim 1 wherein the elevator controller is programmed to establish said speed, acceleration or jerk values by iteratively changing one or more of the speed, acceleration or jerk values of the elevator car during the simulated trip so that the calculated pressure differential value does not exceed the maximum pressure differential value as the elevator travels from the initial location to the destination location during the simulated trip.

7. The elevator controller of claim 1 wherein the elevator controller is programmed to change one or more of the speed, acceleration or jerk of the elevator car during the simulated trip so that the calculated pressure differential value substantially equals the maximum pressure differential value.

8. The elevator controller of claim 1 wherein the elevator controller is programmed to adjust the calculated pressure differential value based on a natural relief value representative of the natural pressure relief associated with the passenger's ear during the time that the elevator car is stopped at an intermediate point between the initial location to the destination location.

9. The elevator controller of claim 8 wherein the natural relief value is about 22 pascals per second.

10. The elevator controller of claim 8 wherein the elevator controller is programmed to increase one or more of the elevator car's speed or acceleration based on the adjusted calculated differential pressure value.

11. The elevator controller of claim 1 wherein said at least one elevator car comprises a plurality of elevator cars, further comprising a plurality of elevator controllers programmed to control movement of a said plurality of elevator cars.

12. The elevator controller of claim 8 wherein said at least one elevator car comprises a plurality of elevator cars, and said elevator controller is programmed to assign one of said plurality of elevator cars to a waiting passenger based on the adjusted differential pressure values of passengers traveling in said plurality of elevator cars.

13. The elevator controller of claim 1 wherein the maximum pressure differential value is in the range of about 100 to 4000 pascals.

14. The elevator controller of claim 1 where the elevator controller is programmed to simulate an elevator trip for each passenger when a new passenger enters the elevator car, to calculate a pressure differential value representative of the pressure difference between said new passenger's middle and outer ear at one or more points during the simulated trip, and to establish values for one or more of the speed, acceleration or jerk of the elevator car during the simulated trip so that the calculated pressure differential value for the new passenger does not exceed the maximum pressure differential value as the elevator car travels from the initial location to the destination location during the simulated trip, and to operate the at least elevator car in accordance with the established values.

15. A method of operating at least one elevator car for vertically conveying at least one passenger between an initial and a destination location comprising the steps of:

(a) determining a maximum pressure differential value representative of the maximum comfortable and safe pressure difference between a passenger's middle and outer ear; and (b) operating the at least one elevator car such that the pressure difference between a passenger's middle and outer ear does not exceed the maximum pressure differential value as the elevator moves between an initial location and a destination location, including the steps of:

(i) simulating an elevator trip between an initial location and a destination location for at least one elevator passenger;

(ii) calculating a pressure differential value representative of the pressure difference between a passenger's middle and outer ear at one or more points during the simulated trip;

(iii) establishing a value for one or more of the speed, acceleration or jerk of the elevator car during the simulated trip so that the calculated pressure differential value does not exceed the maximum pressure differential value as the elevator travels from the initial location to the destination location during the simulated trip; and (iv) operating the elevator car in accordance with the established values.

16. The method according to claim 15 wherein the establishing step includes iteratively changing one or more of the speed, acceleration or jerk of the elevator car during the simulated trip so that the calculated pressure differential value does not exceed the maximum pressure differential value as the elevator travels from the initial location to the destination location during the simulated trip.

17. The method according to claim 16 wherein one or more of the speed, acceleration or jerk of the elevator car are changed during the simulated trip so that the calculated pressure differential value substantially equals the maximum pressure differential value.

18. The method according to claim 15 wherein said determining step includes calculating a pressure differential value representative of the pressure difference between a passenger's middle and outer ear at one or more locations during elevator car travel.

19. The method according to claim 18 wherein the elevator car makes at least one intermediate stop between the initial location and the destination location, and wherein said determining step includes adjusting the calculated pressure differential value based on a natural relief value representative of the natural pressure relief associated with the passenger's ear while the elevator car is stopped at the intermediate stop.

20. The method according to claim 19 where said natural relief value is about 22 pascals per second.

21. The method according to claim 19 wherein said operating step includes increasing one or more of the elevator car's speed or acceleration based on the adjusted calculated differential pressure value.

22. The method according to claim 15 including assigning an elevator car of a plurality of elevator cars to a waiting passenger based on the differential pressure values of passengers traveling in the plurality of elevator cars.

23. The method according to claim 15 wherein the step of simulating an elevator trip comprises simulating an elevator trip for each passenger in the elevator car.

24. The method according to claim 15 wherein the step of simulating an elevator trip comprises simulating the same elevator trip for a group of passengers in the elevator car.

25. The method according to claim 23 wherein none of the passengers' maximum pressure differential value is exceeded.

26. An elevator system comprising:

(a) at least one elevator car for vertically conveying passengers;

(b) a plurality of destination entry devices; and (c) an elevator controller programmed (i) to operate said at least one elevator car to move vertically without pressure differential experienced by a passenger's ear exceeding a maximum pressure differential value;

(ii) to be responsive to the destination entry devices; and (iii) to assign an elevator car of said at least one elevator car to a waiting passenger based on the adjusted differential pressure values of passengers traveling in said elevator car of said at least one elevator car.

27. The elevator system of claim 26 wherein the elevator controller is programmed to calculate a pressure differential value representative of the pressure differential which would be experienced by a passenger's ear at one or more vertical locations associated with elevator car travel, and to establish one or more of the speed, acceleration or jerk of the at least one elevator car so that the calculated pressure differential value does not exceed the maximum pressure differential value.

28. The elevator system of claim 27 wherein the elevator controller is programmed to stop said at least one elevator car at one or more intermediate points between an initial location and a destination location, and to adjust the calculated pressure differential value based on a natural relief value representative of the natural pressure relief associated with the passenger's ear during the time that the elevator car is stopped at said one or more intermediate points.

29. The elevator system of claim 28 wherein the elevator controller is programmed to increase one or more of the elevator car's speed or acceleration based on the adjusted calculated differential pressure value.

30. The elevator system of claim 26 wherein said at least one elevator car comprises a plurality of elevator cars, each elevator car being controlled by said elevator controller.

31. The elevator system of claim 26 comprising at least one sensor operable to monitor a plurality of passengers traveling in the at least one elevator car.

32. The elevator system of claim 31 wherein said at least one sensor is configured to monitor the weight of said passengers, and the elevator controller is programmed to determine when passengers enter or exit said at least one elevator car based on monitoring by said at least one sensor.

33. An elevator system comprising:

(a) at least one elevator car for vertically conveying passengers;

(b) at least one sensor operable to monitor a plurality of passengers traveling in the at least one elevator car, said sensor configured to monitor the weight of said passengers; and (c) an elevator controller programmed (i) to operate said at least one elevator car to move vertically without pressure differential experienced by a passenger's ear exceeding a maximum pressure differential value; and (ii) to determine when passengers enter or exit said at least one elevator car based on monitoring by said at least one sensor.

34. The elevator system of claim 33 wherein the elevator controller is programmed to calculate a pressure differential value representative of the pressure differential which would be experienced by a passenger's ear at one or more vertical locations associated with elevator car travel, and to establish one or more of the speed, acceleration or jerk of the at least one elevator car so that the calculated pressure differential value does not exceed the maximum pressure differential value.

35. The elevator system of claim 34 wherein the elevator controller is programmed to stop said at least one elevator car at one or more intermediate points between an initial location and a destination location, and to adjust the calculated pressure differential value based on a natural relief value representative of the natural pressure relief associated with the passenger's ear during the time that the elevator car is stopped at said one or more intermediate points.

36. The elevator system of claim 33 wherein the elevator controller is programmed to increase one or more of the elevator car's speed or acceleration based on the adjusted calculated differential pressure value.

* * * * *